US005417162A

United States Patent [19]

Adams et al.

[11] Patent Number: 5,417,162

[45] Date of Patent: May 23, 1995

[54] DETONATION COUPLING DEVICE

[75] Inventors: Craig F. Adams, Granby; Richard J. Peebles, Winchester, both of Conn.

[73] Assignee: The Ensign-Bickford Company, Simsbury, Conn.

[21] Appl. No.: 267,417

[22] Filed: Jun. 28, 1994

Related U.S. Application Data

[63] Continuation-in-part of Ser. No. 85,986, Jul. 1, 1993, Pat. No. 5,327,835.

[51] Int. Cl.[6] ..... F42B 3/10; F42B 3/16; F42C 19/08

[52] U.S. Cl. ..... 102/317; 102/320; 102/275.11; 102/275.12

[58] Field of Search ..... 102/317, 320, 275.11, 102/275.2, 275.3, 275.6, 275.7, 275.12

[56] References Cited

U.S. PATENT DOCUMENTS

| | | | |
|---|---|---|---|
| 2,468,274 | 4/1949 | Riley | 102/317 |
| 2,745,281 | 7/1949 | Hanley | 102/275.7 |
| 3,129,663 | 4/1964 | Schnepfe, Jr. | 102/275.4 |
| 3,260,202 | 7/1966 | Bryla | 102/275.4 |
| 3,357,355 | 12/1967 | Roush | 102/317 X |
| 3,460,477 | 8/1969 | Heidemann et al. | 102/275.2 |
| 3,590,739 | 7/1971 | Persson | 102/275.5 |
| 3,678,853 | 7/1972 | Kilmer | 102/275.4 |
| 3,981,240 | 9/1976 | Gladden | 102/275.5 |
| 3,990,367 | 11/1976 | Smith | 102/275.4 |
| 4,294,171 | 10/1981 | Ducharme | 102/317 |
| 4,328,753 | 5/1982 | Kristensen et al. | 102/275.8 |
| 4,335,652 | 6/1982 | Bryan | 102/275.3 |
| 4,607,573 | 8/1986 | Thureson et al. | 102/275.8 |
| 4,608,926 | 9/1986 | Stevens | 102/275.4 |
| 4,632,034 | 12/1986 | Colle, Jr. | 102/320 X |
| 4,699,059 | 10/1987 | Kelly et al. | 102/275.1 |
| 4,756,250 | 7/1988 | Dias dos Santos | 102/275.1 |
| 4,762,067 | 8/1988 | Barker et al. | 102/275.5 |
| 4,838,165 | 6/1989 | Gladden et al. | 102/275.8 |
| 4,846,067 | 7/1989 | Martin | 102/275.6 |
| 4,962,708 | 10/1990 | Snyder et al. | 102/275.11 |
| 4,998,477 | 3/1991 | Barker | 102/275.6 |
| 5,001,821 | 3/1991 | Shaw | 102/275.8 |
| 5,007,661 | 4/1991 | Lenzen | 102/275.8 |
| 5,010,821 | 4/1991 | Blain | 102/275.8 |
| 5,012,741 | 5/1991 | Peebles et al. | 102/275.4 |
| 5,020,435 | 6/1991 | Cawte | 102/275.1 |
| 5,166,470 | 11/1992 | Stewart | 102/275.5 |
| 5,171,935 | 12/1992 | Michna et al. | 102/275.7 |
| 5,327,835 | 7/1994 | Adams et al. | 102/275.11 |

FOREIGN PATENT DOCUMENTS

| | | |
|---|---|---|
| 249329 | 6/1953 | Australia . |
| 913747 | 12/1962 | United Kingdom . |
| 2027176 | 2/1980 | United Kingdom . |
| 2140137 | 11/1984 | United Kingdom . |
| 2255160 | 10/1992 | United Kingdom . |

*Primary Examiner*—Peter A. Nelson

*Attorney, Agent, or Firm*—Victor E. Libert; Frederick A. Spaeth

[57] ABSTRACT

A coupling device (10) for coupling a detonator cap (20) with an unfixtured detonating cord (80, FIG. 3 ) after removing a shipping plug (41, FIG. 2 ), features a sleeve member (12) having a longitudinal sleeve bore (18) extending therethrough for receiving a detonator cap (20) therein. The detonator cap (20) extends to the transition end (22) of the sleeve member (12) so that the detonating cord (80) does not enter the sleeve bore (18). A nut member (14) has an aperture (24) for receiving the cord (80) and is secured to the sleeve member (12) with its aperture (24) aligned with the bore (18). A ferrule (16) is seated on the sleeve member (12) and grips the detonating cord (80) when the nut member (14) is secured onto the sleeve member (12).

17 Claims, 2 Drawing Sheets

DETONATION COUPLING DEVICE

CROSS REFERENCE TO RELATED APPLICATION

This application is a continuation-in-part of application Ser. No. 08/085,986, filed on Jul. 1, 1993 in the name of Craig F. Adams and Richard J. Peebles and entitled "Detonation Device Including Coupling Means", now U.S. Pat. No. 5,327,835.

BACKGROUND OF THE INVENTION

Field of the Invention

This invention relates to a device for use in the initiation of a linear pyrotechnic or explosive means such as detonating cord and, more particularly, to a device for coupling a detonating cap to detonating cord.

In mining and other blasting operations, it is often necessary to join two linear members in signal transmission relationship, such as one detonation signal transmission line to another, or to a linear pyrotechnic or explosive member, so that a detonation signal may pass from one to the other. One of such linear devices may be, e.g., a signal transmission line such as shock tube, which generally comprises a hollow tube which has a coating of a reactive material, e.g., pulverulent PETN or a mixture of powdered aluminum and a pulverulent explosive, on its interior wall. See, e.g., U.S. Pat. No. 3,590,739 to Persson, dated Jul. 6, 1971 and U.S. Pat. No. 4,607,573 to Thureson et al dated Aug. 26, 1986. It is often necessary to amplify a signal by use of a detonator cap in order to initiate another device or signal transmission line. Accordingly, a signal transmission line such as a shock tube may be connected at one end with a detonator cap which is detonated by the ignition signal transmitted through the shock tube and which releases, upon detonation, energy sufficient to detonate another device to which the initiation signal is thus transferred. The prior art reflects a knowledge of a variety of coupling devices by which the detonator cap is disposed in signal transmission relation to a target device.

U.S. Pat. No. 3,129,663 to Schnepfe, Jr., dated Apr. 21, 1964 discloses a fitting for low energy detonating cord. The fitting or coupling 10 joins two lengths of low energy detonating cord (LEDC) each of which has a booster cup 21 crimped at their respective ends. The coupling 10 has a longitudinal bore therethrough dimensioned and configured to receive the ends of the respective LEDC lines such that the booster cups are adjacent to one another within the coupling. Further, each LEDC has a ferrule crimped thereto providing a flange, e.g., 24, which bears against the end 27 of the coupling. The LEDC passes through a threaded connector cap 38 which cooperates with corresponding threads at the ends 27 of coupling 10, to clamp flange 24 therebetween when cap 38 is secured onto end 27. Coupling 10 is also provided with relief vents 41 that are protected by bushings 43. The ends of both LEDC lines must be equipped with the crimped ferrules in order for the coupling to function.

U.S. Pat. No. 3,460,477 to Heidemann et al, dated Aug. 12, 1969 discloses a one-way detonation transfer device that features opposing threaded wells for receiving the ends of detonating cords having threaded fixtures secured thereto.

SUMMARY OF THE INVENTION

The present invention provides a detonation coupling device for coupling a detonator cap in signal transmitting relationship with a detonating cord, that is, so that detonation of the detonator cap will detonate the detonating cord, the coupling device of the invention providing a quick-acting, waterproof connection.

More specifically, in accordance with the present invention, there is provided a detonation coupling device comprising means for coupling a detonator cap having an active end with a detonating cord, the device comprising the following components. A sleeve member has a transition end at which the coupled detonator cap and detonating cord face each other and also has a longitudinal sleeve bore extending therethrough, the sleeve bore being dimensioned and configured to receive therein the detonator cap with the active end thereof disposed at the transition end of the sleeve member so that the detonator cap blocks entry of the detonating cord into the sleeve bore. A fastener member having a fastener aperture dimensioned and configured to receive a detonating cord therethrough is provided. The sleeve member has sleeve engagement means and the fastener member has complementary fastener engagement means, the respective engagement means cooperating to secure the fastener member to the sleeve member with the fastener aperture aligned with the sleeve bore. A cord compression means is carried between the sleeve member and the fastener member and has therein a compression means aperture, the compression means aperture comprising a cord-receiving portion. The sleeve member and the fastener member are dimensioned and configured to compress the cord compression means between them when the fastener member is secured to the sleeve member, to cause the cord compression means to grip a detonating cord disposed in the cord-receiving portion of the aperture.

According to one aspect of the present invention, the sleeve member and the cord compression means are dimensioned and configured so that, when the fastener member is secured to the sleeve member, a part of the cord compression means resides in a radially enlarged portion of the sleeve bore at the transition end of the sleeve member. The compression means aperture further includes a cap-receiving portion that extends within the radially enlarged portion of the sleeve bore to receive therein the active end of the detonator cap disposed in the sleeve bore.

According to another aspect of the invention, the cord compression means may comprise a compressible ferrule and the sleeve member may comprise a ferrule seat, the ferrule being disposed in the ferrule seat, the fastener member comprising a compression surface dimensioned and configured to compress the ferrule when the fastener member is secured to the sleeve member.

According to various other aspects of the invention, at least the sleeve member may be comprised of a resilient material able to withstand substantially without producing shrapnel the release of energy upon detonation of a detonator cap in the sleeve member and to contain the shrapnel produced by the detonator cap; at least the fastener member may be comprised of a friable material which, upon detonation of a detonator cap disposed in the cap-receiving end of the sleeve bore, disintegrates without substantial production of shrapnel.

According to another aspect of the invention, the device may further comprise the detonator cap disposed in the sleeve bore with the active end of the detonator disposed at the transition end of the sleeve member, for detonating a detonating cord disposed in the device, and a signal transmission line having one end in signal communication with the detonator cap and having an opposite, distal end. In such case, an initiator may be connected to the distal end of the signal transmission line, for producing an initiation signal to be transmitted from the initiator to the detonator cap via the signal transmission line. The detonator cap may comprise a directional detonator element for directing the energy of the detonation to the detonating cord disposed in the cord compression means. The directional detonator element may comprise a cylindrical bushing received within the active end of the detonation cap and having an axial bore within which is disposed an explosive charge, the bushing being dimensioned and configured to direct the energy released by detonation of the explosive charge toward the detonating cord disposed in the compression means.

Another aspect of the invention provides for a detonating cord to be received within the compression means aperture and having an end which faces the active end of the detonator cap.

According to still another aspect of the invention, the device may further comprise sealing means, e.g., an O-ring, associated with at least one of the sleeve member and the fastener member for sealing at least one of the sleeve bore and the ferrule aperture against leakage of water therein. The device may be combined with a shipping plug snugly received in the compression means aperture.

DETAILED DESCRIPTION OF THE INVENTION AND PREFERRED EMBODIMENTS THEREOF

The present invention relates to a coupling device which may be used to couple a detonation device, e.g., a detonator cap, to the end of a detonating cord. The invention allows for a secure, reliable connection between a detonator cap and the detonating cord without the need for affixing specially adapted hardware to the end of the detonating cord. Generally, this advantage is achieved by providing a coupling device into which an end of a detonating cord can be inserted and secured by a mechanism that can grip the cord after it is in place. Such a mechanism generally comprises a compression portion or the like that is disposed in close proximity to the cord and that can be compressed to grip and thus retain the cord in the coupling device, where it may be disposed for detonation by a suitable device, e.g., a detonator cap. Thus, detonating cord can be measured and cut in the field and easily coupled to a detonation device with a minimum of inconvenience.

Optionally, a detonator cap may be factory-assembled to the coupling device to provide a detonation device that is easily and quickly coupled to a detonating cord. A signal transmission line such as a shock tube may be factory-assembled to the detonator cap; and an ignition device may optionally be factory-assembled to the distal end of the signal transmission line to provide a self-contained device which can be quickly connected to a detonating cord.

Figure 1:
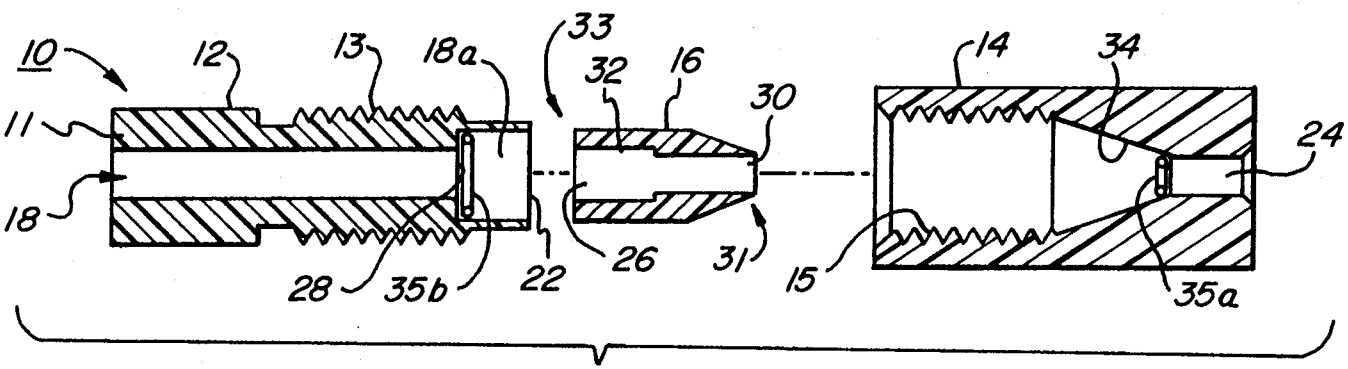
FIG. 1 is an elevational exploded cross-sectional view of a detonation coupling device according to one embodiment of the present invention.

As shown in FIG. 1, a coupling device 10 according to one embodiment of the present invention may comprise a sleeve member 12 and a fastener member which, in the illustrated embodiment is a nut member 14, and cord compression means comprising, in the illustrated embodiment, a ferrule 16.

Sleeve member 12 has a longitudinal sleeve bore 18 that extends through sleeve member 12 from entry end 11 to transition end 22 thereof. Sleeve bore 18, which includes a radially enlarged portion **18*a* at the transition end 22 of sleeve member 12, is dimensioned and configured to receive a detonator cap therein. Transition end 22 is the end of sleeve member 12 at which the active end (20*a* in FIG. 2), i.e., the explosive charge-containing end of a detonator cap, such as detonator cap 20 of FIG. 2, faces or abuts the end of a detonating cord such as detonating cord 80 of FIG. 3, when the detonator cap 20 is properly received within sleeve bore 18. With this arrangement, detonator cap 20 blocks entry of the detonating cord (or shipping plug 41, discussed below) into sleeve bore 18. Portion 18*a* of sleeve bore 18 is disposed at transition end 22 and its enlarged diameter relative to the rest of sleeve bore 18 serves to define a shoulder (unnumbered) which provides a ferrule seat 28 which serves to receive ferrule 16. Sleeve member 12 has threads 13 formed thereon which provide an engagement means that cooperates with complementary engagement means provided by threads 15 formed on the nut member 14 so that nut member 14 can be secured onto sleeve member 12**, as described below.

Nut member 14 has an aperture 24 extending therethrough which is dimensioned and configured to receive a detonating cord for passage therethrough. Nut member 14 also comprises engagement means comprising threads 15 that cooperate with the sleeve member engagement means (threads 13) described above. Finally, nut member 14 comprises a compression surface 34 that bears upon the ferrule 16 as described below when nut member 14 is secured onto sleeve member 12.

Ferrule 16 has a ferrule aperture 26 extending therethrough comprising a cord-receiving portion 30 which is dimensioned and configured to receive therein a detonating cord or a shipping plug 41 (FIG. 2) dimensioned and configured to simulate the dimensions of a detonating cord. Ferrule 16 comprises a seat portion 33 which is dimensioned and configured to be received in ferrule seat 28 of sleeve member 12 in a manner such that ferrule aperture 26 is aligned with the sleeve bore 18. Ferrule aperture 26 also comprises a cap-receiving portion 32 that is dimensioned and configured so that when ferrule 16 is in ferrule seat 28 and a detonator cap 20 is disposed in sleeve bore 18, the active end **20*a* of the detonator cap is disposed at the transition end 22 of sleeve member 12. Thus, a detonating cord inserted through the cord-receiving portion 30 of ferrule aperture 26 will be prevented by the detonator cap 20 from entering into sleeve bore 18 but its end will abut or face the active end 20***a* of the detonator cap 20. In other embodiments of the invention the device may be dimensioned and configured to allow the active end 20*a* of the detonator cap to be disposed beyond transition end 22 and further into ferrule aperture 26.

Ferrule 16 also comprises a compressible compression portion 31 which, in response to a compression force applied thereto, constricts the ferrule aperture 26 and thus grips a detonating cord or shipping plug disposed therein. The necessary compression force is supplied by complementary fastener compression means provided by the compression surface 34 on nut member 14 when it is secured onto sleeve member 12. The compression force thus applied on compression portion 31 causes compression portion 31 to constrict and thus grip a detonating cord that may be disposed in the ferrule aperture.

Figure 1A:
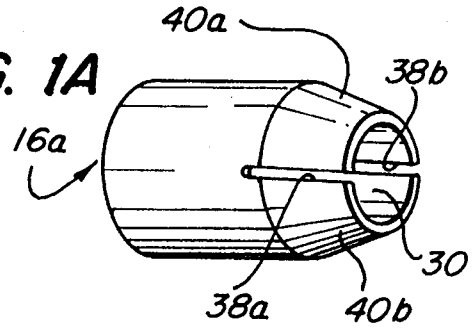
FIG. 1A is a perspective view of an alternative ferrule member for use in a coupling device according to the present invention.

The compression portion of ferrule 16 may optionally comprise at least one, but preferably two, slots, as in ferrule 16*a* of FIG. 1A. Slots 38*a* and 38*b* define two tangs 40*a* and 40*b* about the cord-receiving portion of the ferrule aperture which flex to grip a detonating cord or shipping plug therein when a compression force is applied thereto. (The ferrule aperture is un-numbered in FIG. 1A but corresponds to ferrule aperture 26 of the FIG. 1 embodiment.)

The sleeve member 12 and nut member 14 comprise respective engagement means that cooperate to allow the user to secure the nut member 14 onto sleeve member 12 and thus compress the ferrule as described above. In the illustrated embodiments, the sleeve engagement means comprises the threads 13 formed on the exterior of sleeve member 12. The fastener engagement means are provided by intermeshing threads 15 formed on the interior of nut member 14. Threads 13 and 15 are configured to allow nut member 14 to be screwed onto sleeve member 12, causing compression surface 34 of nut member 14 to bear upon the compression portion 31 of ferrule 16. However, it will be appreciated that any other suitable complementary engagement means may be employed in place of threads, e.g., a detent and fence arrangement may be used. Preferably, the engagement means are releasable so that nut member 14 may be secured to sleeve member 12 to cause the compression portion 31 of ferrule 16 to retain shipping plug 41 (FIG. 2) in cord-receiving portion 30 of ferrule aperture 26, and may subsequently be loosened so that the shipping plug may be removed and the end of a detonating cord may be inserted into the cord-receiving portion 30. Nut member 14 may then be re-secured to sleeve member 12 to retain the detonating cord therein.

In the foregoing embodiment, the cord compression means comprises a ferrule that is physically separate from the sleeve member and nut member. However, in alternative embodiments, the cord compression means may be formed integrally with either the nut member or the sleeve member.

Figure 2:
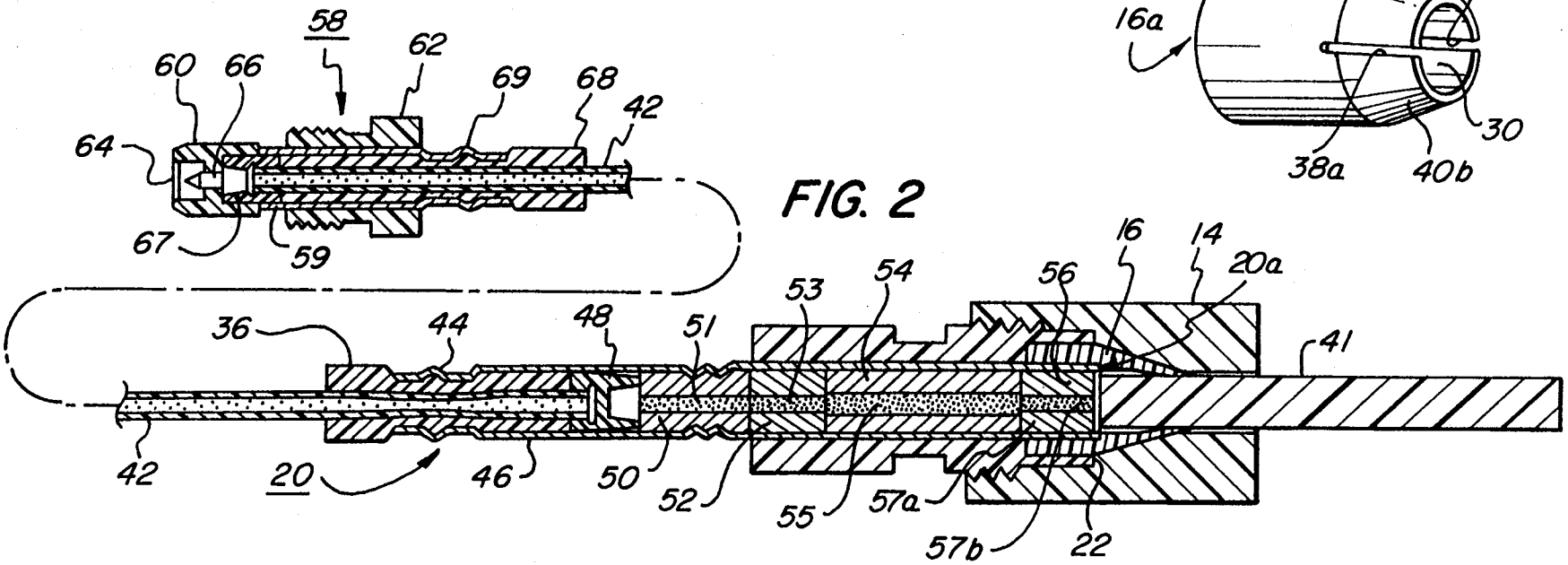
FIG. 2 is an elevational cross-sectional view of the detonation coupling device of FIG. 1 associated with a detonation device having an initiator connected thereto, the detonation coupling device further having a shipping plug.

Detonating cord, as is known, typically comprises a linear core of explosive material such as PETN, enclosed in a waterproof casing. The waterproof casing is advantageous since detonating cord is often used outdoors where it is exposed to the elements and because moisture impairs the effectiveness of the explosive material. However, when the cord is cut, the exposed core is vulnerable to water contamination. Therefore, coupling device 10 preferably further comprises optional sealing means to provide a water-tight seal between sleeve member 12 and the detonating cord therein when nut member 14 is secured onto sleeve member 12. Such sealing means may comprise, e.g., O-rings 35*a* and 35*b* (FIG. 1), which have diameters sufficient to receive therein, respectively, the detonating cord 80 (FIG. 3) and the active end 20*a* of a detonator cap 20 (FIG. 2). O-ring 35*a* is dimensioned and configured to sealingly bear against compression surface 34 and compression portion 31 of ferrule 16, and optionally against a detonating cord or shipping plug inserted through nut member 14 when the nut member 14 is secured onto sleeve member 12. O-ring 35*b* is disposed in the ferrule seat between ferrule 16 and ferrule seat 28, so that when nut member 14 is secured onto the sleeve member, the resulting compressive force causes O-ring 35*b* to sealingly bear against seat portion 33 of ferrule 16 and ferrule seat 28 of sleeve member 12. O-ring 35*b* may also bear against and form a seal about a detonator cap that may be protruding from sleeve bore 18 into transition end 22. O-ring 35*a* prevents the introduction of water into the ferrule aperture through any gap between nut member 14 and ferrule 16, and O-ring 35*b* prevents the introduction of water into the ferrule aperture through any gap between sleeve member 12 and ferrule 16. Thus, O-rings 35*a* and 35*b* prevent water from entering into the coupling device from about the compression means where the exposed core of the detonating cord will be disposed.

In FIG. 2, the connector device of FIG. 1 is shown assembled and with a detonator cap 20 disposed in the sleeve bore (18 of FIG. 1). Ferrule 16 resides partially in ferrule seat 28, but extends beyond the transition end 22 of sleeve member 12. As illustrated, active end 20*a* of detonator cap 20 is disposed at transition end 22, and accordingly, when the detonation coupling device 10 is assembled as shown in FIG. 2, the active end 20*a* of detonator 20 protrudes into cap receiving portion 32 of ferrule aperture 26. When the detonating cord (80, FIG. 3) is inserted into the device 10, it is prevented by detonator cap 20 from entering into sleeve bore 18, including the radially enlarged portion 18*a* thereof.

Detonator cap 20 is a shock tube-sensitive blasting cap comprising a bushing 36 within which a shock tube 42 is received, and which cooperates With crimp 44 to secure shock tube 42 within shell 46 of detonator cap 20. The end of shock tube 42 within detonator cap 20 bears against an isolation cup 48 which, as is known in the art, serves to reduce the chance of premature detonation of detonator cap 20 by diverting any static electricity that may develop on shock tube 42 away from the detonating charge of detonator cap 20 and towards metal shell 46. Such isolation cups are described in U.S. Pat. 3,981,240 to Gladden, dated Sep. 21, 1976, the disclosure of which is hereby incorporated herein by reference.

Isolation cup 48 bears against sealer element 50 which has a core 51 of pyrotechnic material. Adjacent to sealer element 50 is a starter element 52 which has a core 53 of pyrotechnic material. The detonator cap 20 in the embodiment of FIG. 2 is of a delay type and further comprises a delay element 54 having a relatively slow burning pyrotechnic core 55. After the desired delay, which is typically of a duration of milliseconds, the initiation signal is transmitted to the detonator element 56, which then detonates to initiate detonation of a detonating cord disposed in the cord-receiving portion of ferrule 16 in place of shipping plug 41. The disposition of a detonator element in the end of shell 46 characterizes that end of the shell as the active end. Preferably, the detonator element 56 comprises a cylindrical bushing 57*a* having therein the axially disposed detonatable core 57*b* comprising a suitable quantity of detonatable material, e.g., lead azide. Preferably, bushing 57*a* is made of a material such as stainless steel and is of a thickness sufficient to withstand the detonation of the detonatable core 57*b* therein and thus inhibits the release of energy in radial directions from the core. Accordingly, the energy released upon the detonation of the core 57*b* will be directed longitudinally toward the end of detonator cap 20, and thus towards the detonating cord to be situated in place of plug 41. Detonator element 56 can therefore be described as a directional detonator element.

As seen in FIG. 2, detonator cap 20 is associated with an initiator 58 and a signal transmission line provided by a shock the 42. One end of the shock tube 42 is connected to the detonator cap 20 and the opposite end of shock tube 42 is connected to initiator 58 to provide signal communication between the detonator cap 20 and initiator 58, to provide an initiation-detonation device. In the embodiment of FIG. 2, initiator 58 is a percussive initiator comprising a shell 59 that includes an end fitting 60 which is dimensioned and configured to be received within a percussive triggering device, e.g., a flare gun (not shown), and to be secured therein by means of a hex nut 62. End fitting 60 carries a primer cap 64, such as those available from Olin Corporation under the designation M42Cl, which can be initiated by a percussive strike received from the triggering device. Primer cap 64 faces an isolation cup 67 through an intervening through-hole 66. The end of shock tube 42 is disposed against the membrane of isolation cup 67 opposite from primer cap 64 and is retained in the shell by bushing 68 and crimp 69.

It is preferred to ship and handle a detonating device with a shipping plug 41 secured in the cord-receiving end of sleeve member 12 as shown in FIG. 2, and to withdraw the shipping plug and insert the end of a detonating cord therein prior to use. Shipping plug 41 serves to inhibit the introduction of moisture and foreign materials which might otherwise enter ferrule aperture 26 of ferrule 16 during shipping and handling of a detonation device and later interfere with detonation of a detonating cord therein. Shipping plug 41 also serves to contain any reaction by-products and shrapnel within the unit in the event of inadvertent initiation of the device while it is still in the shipping configuration. Such containment is advantageous for inhibiting sympathetic detonation of adjacent-reactive materials. When the user is ready to secure a detonating cord in the coupling device, nut member 14 may be released from sleeve member 12, allowing ferrule 16 to "ungrip" shipping plug 41, which may then be removed. The end of a detonating cord may then be inserted into the apertures in nut member 14 and ferrule 16, and nut member 14 may then be re-secured onto sleeve member 12 so that ferrule 16 grips and retains the detonating cord therein.

Figure 3:
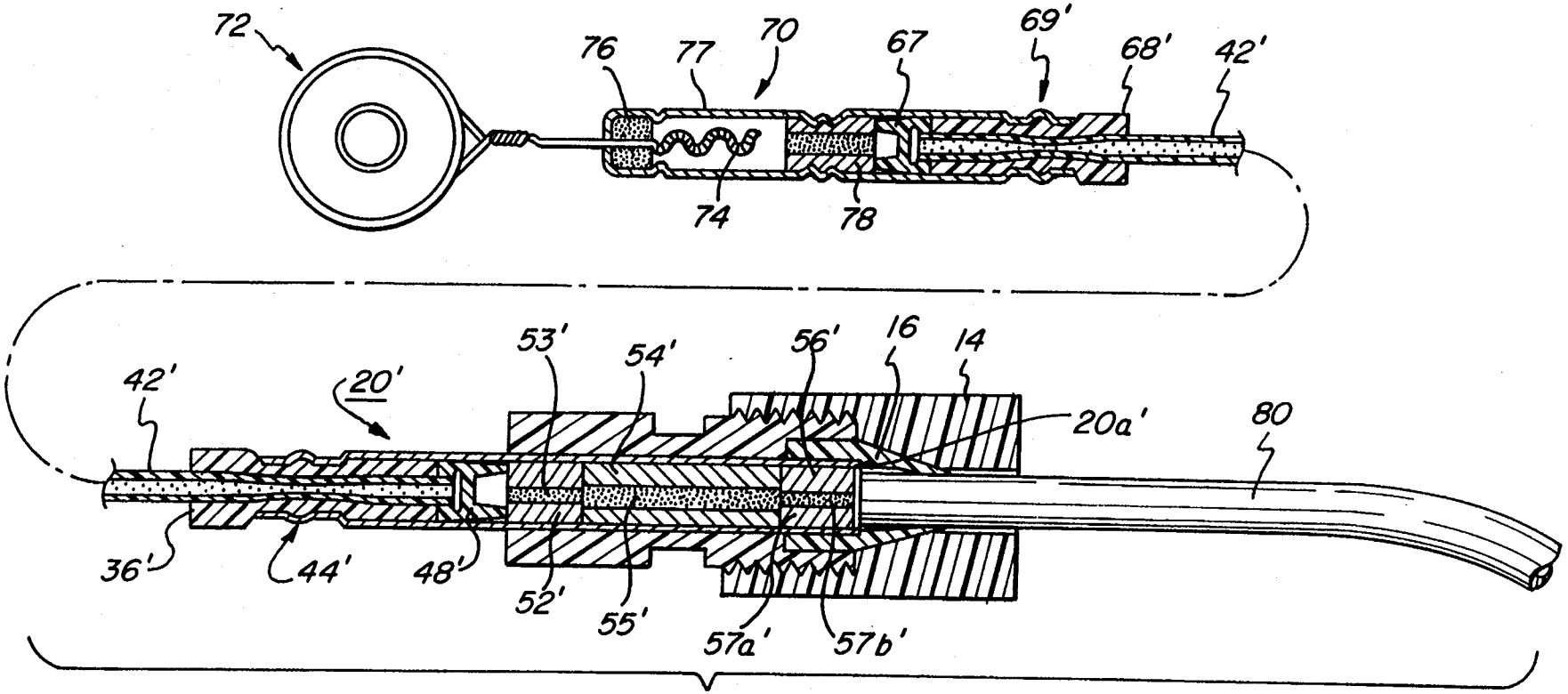
FIG. 3 is an elevational view of the detonation coupling device of FIG. 2 associated with a detonation device having connected thereto an initiator different from that of FIG. 2, and the detonation coupling device having a detonating cord positioned therein for detonation.
Figure 1:
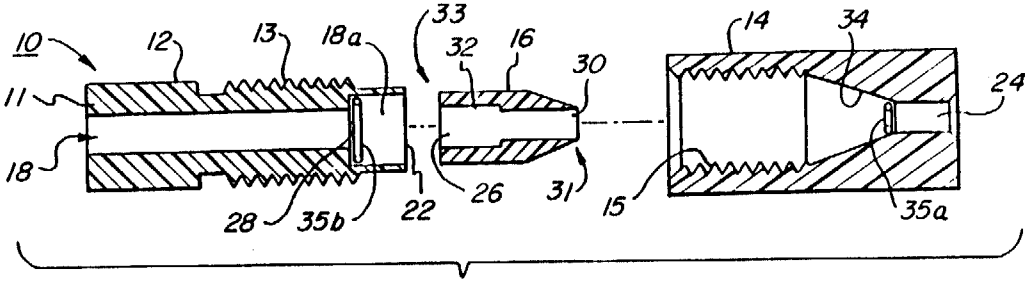
Figure 1A:
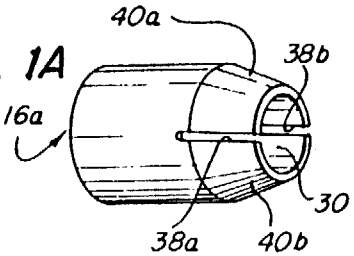
Figure 2:
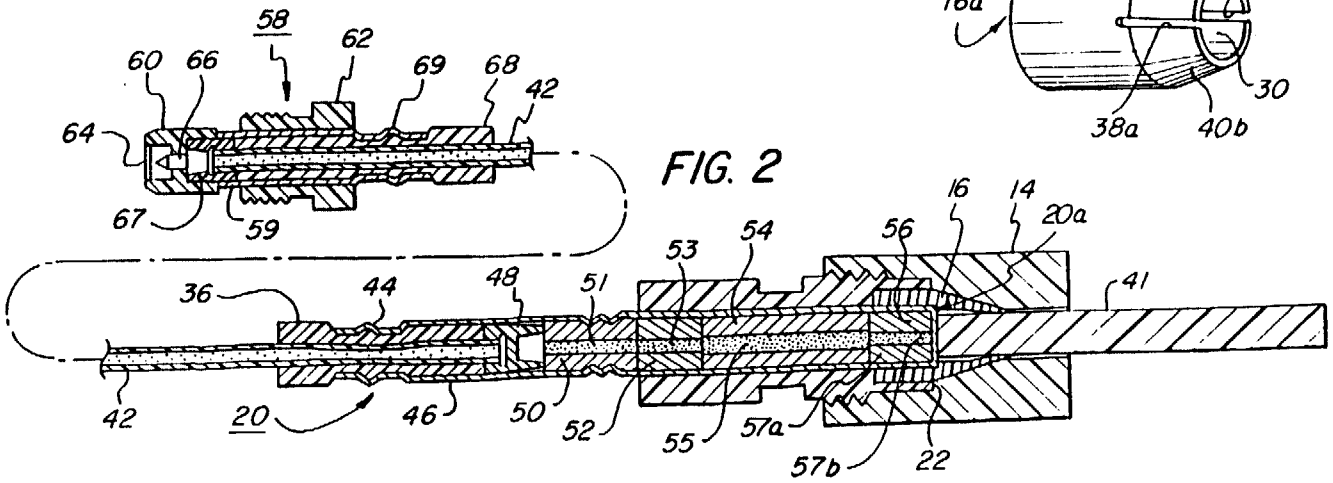
Figure 3:
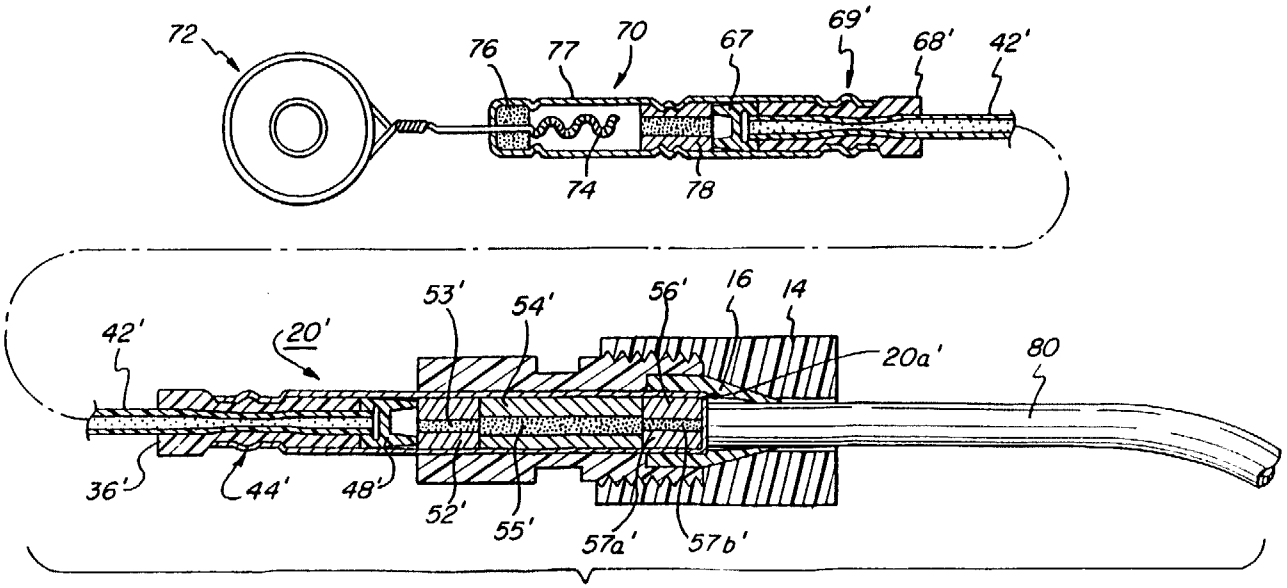

The assembled device shown in FIG. 2, when shipping plug 41 is replaced by a detonating cord such as detonating cord 80 of FIG. 3, allows the user to send an initiation signal from a triggering device (not shown) attached to initiator 58 which is at a remote distance from detonator cap 20 and from the detonating cord disposed in coupling device 10, and thus provides a degree of safety to the user. In use, initiator 58 is attached to a triggering device which percussively detonates primer cap 64. The energy released upon detonation penetrates isolation cup 67 and initiates a signal in shock tube 42. The initiation signal travels the length of shock tube 42, penetrates isolation cup 48 and passes through sealer element 50 to starter element 52. The signal is received by delay element 54 from starter element 52, and after a pre-determined delay, delay element 54 detonates detonator element 56. As discussed above, the bushing of the detonator element tends to focus the energy released by the explosive core of detonator element 56 onto the end of a detonating cord (such as 80 in FIG. 3) disposed in the coupling device to initiate the detonating cord.

One of the problems encountered by users of detonation devices is that the blasting cap and associated coupling device can release shrapnel that can cause injury. In one aspect, the present invention serves to alleviate this problem by providing a coupling device which absorbs or disperses the energy released upon detonation of the detonator cap. For example, a coupling device 10 may comprise a friable material which, upon being subjected to the detonation of a detonator cap disposed therein, disintegrates into powder-like particles of low mass. The kinetic energy of the powder particles is readily absorbed by the surrounding air so that persons disposed within a relatively close range of the detonation are not injured by the particles. A suitable test for the safety of a coupling device is to detonate the device at a distance of about 18 inches (45.72 cm) from a latex glove filled with a gel having approximately the consistency of human flesh, with the glove disposed in front of a witness board, which may be a sheet of stencil oil board or a sheet of any yielding material on which the impact of hazardous shrapnel particles will be evident. The absence of damage to the glove and/or the witness board indicates that no substantial amounts of shrapnel were produced by the detonation.

Materials that yield safe coupling devices may include such materials as rigid foam urethane and machineable waxes, which would be expected to produce little or no fragmentation, i.e., shrapnel, hazards. In one embodiment, a coupling device according to the present invention comprises a sleeve member made of polyethylene and a fastener member and ferrule made from foamed polyurethane. In a test trial, a coupling device according to the present invention comprised a ferrule and fastener member made from a rigid foam polyurethane sold by the General Plastics Company under the designation 3715, and a sleeve member made from low density polyethylene that conformed to military specification LP-390. The coupling device was used to couple a detonating cord to a detonator cap that was detonated at a distance of 18 inches (45.72 cm) from a gel-filled latex glove and witness board that showed no resulting damage. The polyethylene sleeve member remained intact, and the ferrule and fastener member disintegrated substantially into powder without producing substantial amounts of hazardous shrapnel fragments.

In alternative embodiments, coupling device 10 may comprise a resilient synthetic elastomeric material such as 60 Shore A durometer Santoprene TM rubber, which is available from the Monsanto Company. Other such materials might include, for example, 45 durometer Santoprene TM rubber, molded and extruded urethanes, and thermoplastic rubbers. Such materials may expand or fracture upon detonation but will not fragment into hazardous shrapnel.

FIG. 3 shows the coupling device 10 of FIG. 2 used in conjunction with a different kind of initiator which, in the illustrated embodiment, comprises, instead of a percussive initiator such as initiator 58, a conventional pull-ring initiator 70. As is known in the art, initiator 70 may comprise a pull-ring 72 which draws a phosphorus-coated wire 74 through a scratch plug 76 situated in shell 77, producing a flame that sets off an ignition element 78. The initiation signal produced by ignition element 78 penetrates isolation cup 67 and passes to shock tube 42' which is retained in shell 77 by bushing 68' and crimp 69'. The initiation signal travels to detonator cap 20' via shock tube 42'. The construction of detonator 20' is, with the exception described below, substantially identical to that of detonator 20 of FIG. 2 and parts of detonator 20' are identically numbered to like parts of detonator 20 except for the addition of a prime indicator, and are not further described. The difference between detonator caps 20 and 20' is that in the latter the sealer element 50 is omitted. As described above, detonator cap 20' is initiated via initiator 70 and shock tube 42' to in turn initiate a signal in detonating cord 80 following the predetermined delay.

The embodiments illustrated herein depict a signal transmission line such as shock tube as being the means to deliver the initiation signal to the detonator cap. However, as is well-known to those skilled in the art, other types of signal transmission could be used including, but not limited to, electrically initiated detonator caps.

While the invention has been described in detail with reference to a particular embodiment thereof, it will be apparent that upon a reading and understanding of the foregoing, numerous alterations to the described embodiments will occur to those skilled in the art and it is intended to include such alterations within the scope of the appended claims.

What is claimed is:

1. A detonation coupling device comprising means for coupling a detonator cap having an active end with a detonating cord, the device comprising:

a sleeve member having a transition end at which the coupled detonator cap and detonating cord face each other, the sleeve member further having a longitudinal sleeve bore extending therethrough which is dimensioned and configured to receive therein the detonator cap with the active end thereof disposed at the transition end of the sleeve member so that the detonator cap blocks entry of the detonating cord into the sleeve bore;

a fastener member having a fastener aperture dimensioned and configured to receive a detonating cord therethrough;

sleeve engagement means on the sleeve member and complementary fastener engagement means on the fastener member, the respective engagement means cooperating to secure the fastener member to the sleeve member with the fastener aperture aligned with the sleeve bore; and a cord compression means carried between the sleeve member and the fastener member and having therein a compression means aperture comprising a cord-receiving portion, the sleeve member and the fastener member being dimensioned and configured to compress the cord compression means between them when the fastener member is secured to the sleeve member, to cause the compression means to grip a detonating cord disposed in the cord-receiving portion of the aperture.

2. The device of claim 1 wherein the sleeve member and the cord compression means are dimensioned and configured so that, when the fastener member is secured to the sleeve member, a part of the cord compression means resides in a radially enlarged portion of the sleeve bore at the transition end of the sleeve member, and the compression means aperture further comprises a cap-receiving portion that extends within the radially enlarged portion of the sleeve bore to receive therein the active end of the detonator cap disposed in the sleeve bore.

3. The device of claim 2 wherein the cord compression means comprises a compressible ferrule and the sleeve member comprises a ferrule seat and the ferrule is disposed in the ferrule seat, and wherein the fastener member comprises a compression surface dimensioned and configured to compress the ferrule when the fastener member is secured to the sleeve member.

4. The device of claim 1 wherein at least the fastener member is comprised of a friable material which, upon detonation of the detonator cap disposed in the cap-receiving end of the sleeve bore, disintegrates without substantial production of shrapnel.

5. The device of claim 1 wherein at least the sleeve member is comprised of a resilient material able to withstand substantially without producing shrapnel the release of energy upon detonation of a detonator cap in the sleeve member and to contain the shrapnel produced by the detonator cap.

6. The device of any one of claims 1, 2 or 3 further comprising a detonator cap disposed in the sleeve bore with the active end of the detonator disposed at the transition end of the sleeve member, for detonating a detonating cord disposed in the device, and a signal transmission line having one end in signal communication with the detonator cap and having an opposite, distal end.

7. The device of claim 6 further comprising an initiator connected to the distal end of the signal transmission line, for producing an initiation signal to be transmitted from the initiator to the detonator cap via the signal transmission line.

8. The device of claim 6 wherein the detonator cap comprises a directional detonator element for directing the energy of the detonation to the detonating cord disposed in the cord compression means.

9. The device of claim 8 wherein the directional detonator element comprises a cylindrical bushing received within the active end of the detonation cap and having an axial bore within which is disposed an explosive charge, the bushing being dimensioned and configured to direct the energy released by detonation of the explosive charge toward the detonating cord disposed in the cord compression means.

10. The device of claim 6 further comprising sealing means associated with at least one of the sleeve member and the fastener member for sealing at least one of the longitudinal sleeve bore and the ferrule aperture against leakage of water therein.

11. The device of claim 10 wherein the sealing means comprises at least one O-ring.

12. The device of claim 6 in combination with a shipping plug snugly received in the compression means aperture.

13. The device of claim 6 further including a detonating cord received within the compression means aperture and having an end which faces the active end of the detonator cap.

14. A detonation coupling device for coupling a detonator cap with a detonating cord, the device comprising:

a sleeve member having therein a longitudinal sleeve bore and terminating in a transition end, the sleeve bore being dimensioned and configured to receive therein a detonator cap having an active end with the active end of the detonator cap disposed substantially adjacent to the transition end of the sleeve bore, whereby the detonator cap will block entry into the sleeve bore of a detonator cord received within the coupling device, the sleeve member defining a ferrule seat near the transition end;

a fastener member having a fastener aperture dimensioned and configured to receive therethrough a detonating cord, and defining a compression surface;

sleeve engagement means on the sleeve member and complementary fastener engagement means on the fastener member, the respective engagement means cooperating to secure the fastener member to the sleeve member with the fastener aperture aligned with the sleeve bore; and a ferrule defining a ferrule aperture dimensioned and configured to receive a detonating cord therein, the ferrule being disposed partially in the ferrule seat, the compression surface on the fastener member serving to compress the ferrule when the fastener member is secured to the sleeve member, so that the ferrule can grip a detonating cord which is disposed in the ferrule aperture.

15. The device of claim 14 further comprising a detonator cap having an active end and disposed in the sleeve bore for detonating a detonating cord disposed in the device, and a signal transmission line having one end in signal communication with the detonator cap and having an opposite, distal end.

16. The device of claim 15 further comprising an initiator connected to the distal end of the signal transmission line, for producing an initiation signal to be transmitted from the initiator to the detonator cap via the signal transmission line.

17. The device of claim 14 further including a detonating cord received within the ferrule aperture and having an end which faces the active end of the detonator cap.

* * * * *

UNITED STATES PATENT AND TRADEMARK OFFICE

CERTIFICATE OF CORRECTION

PATENT NO. : 5,417,162

DATED : May 23, 1995

INVENTOR(S) : Craig F. Adams et al

It is certified that error appears in the above-indentified patent and that said Letters Patent is hereby corrected as shown below:

In column 1, line 18, replace "detonating cap" with --detonator cap--.

In column 3, line 17, replace "detonation" with --detonator--.

In column 6, line 48, replace "With" with --with--.

In column 7, line 22, replace "shock the 42" with --shock tube 42--,
line 41, replace "detonating" with --detonation--, and
line 55, delete the hyphen between "adjacent" and "reactive".

In column 10, line 56 (Claim 9), replace "detonation" with --detonator--.

In column 11, line 18 (Claim 14), replace "detonator" with --detonating--.

Replace Figures 2 and 3 of the issued patent with the enclosed Figures 2 and 3.

Signed and Sealed this

Second Day of January, 1996

*Attest:*

*Attesting Officer*

BRUCE LEHMAN

*Commissioner of Patents and Trademarks*